US005271356A

United States Patent [19]

Kling et al.

[11] Patent Number: 5,271,356

[45] Date of Patent: Dec. 21, 1993

[54] LOW PROFILE SOOTBLOWER NOZZLE

[75] Inventors: Sean Kling, Dublin; Mark A. Bunton, Lancaster; Thomas E. Moskal, Pickerington, all of Ohio

[73] Assignee: The Babcock and Wilcox Company, New Orleans, La.

[21] Appl. No.: 955,115

[22] Filed: Oct. 1, 1992

[51] Int. Cl.[5] ..... F22B 37/52

[52] U.S. Cl. ..... 122/392; 15/316.1; 15/317; 122/379; 239/461; 239/518

[58] Field of Search ..... 122/379, 382, 391, 392, 122/390; 15/316.1, 317, 318; 239/461, 518

[56] References Cited

U.S. PATENT DOCUMENTS

| | | | |
|---|---|---|---|
| 4,676,201 | 6/1987 | Lahoda et al. | 122/392 |
| 4,769,085 | 9/1988 | Booij | 122/392 R |
| 4,773,357 | 9/1988 | Scharton et al. | 122/382 |
| 5,063,632 | 11/1991 | Clark et al. | 15/316.1 |

FOREIGN PATENT DOCUMENTS 57-157927 9/1982 Japan .

OTHER PUBLICATIONS

M. I. Jameel, D. E. Cormack and H. N. Tran, *Initial Expansion Region of an Underexpanded Nozzle*, pp. 1-33.

Thomas V. Giel, Jr. and Thomas J. Mueller, *Mach Disk in Truncated Plug Nozzle Flows* vol. 13, No. 4, dated Apr. 1976, pp. 203-207.

*Primary Examiner*—Edward G. Favors

*Attorney, Agent, or Firm*—Harness, Dickey & Pierce

[57] ABSTRACT

A nozzle assembly for a sootblower used to project a fluid cleaning medium against internal surfaces of a combustion device. The nozzle block assembly of this invention incorporates a converging/diverging throat configuration having a truncated center plug in the flow nozzle which provides improved jet flow characteristics within the limited nozzle length available in the sootblower environment. Various techniques for supporting the truncated plug of this invention are disclosed.

37 Claims, 4 Drawing Sheets

LOW PROFILE SOOTBLOWER NOZZLE

BACKGROUND AND SUMMARY OF THE INVENTION

This invention generally relates to sootblowers which are used to project a stream of a sootblowing medium against internal surfaces of a combustion device for cleaning the surfaces. In particular, this invention concerns a nozzle assembly which produces a cleaning effect which is superior to nozzles of conventional design.

Sootblowers are used to project a stream of cleaning medium such as water, air or steam against heat transfer surfaces within a combustion device such as large scale boilers to cause slag and ash encrustations to be removed. The cleaning medium impacting against the surfaces causes adhering layers to be removed. Various types of sootblowers are used. One general category of sootblowers is known as the long retracting type. These devices have a retractable lance tube which is periodically advanced into and withdrawn from the boiler, and may be simultaneously rotated such that one or more nozzles on the lance tube project a jet of cleaning medium which traces a helical path. In typical retracting sootblowers, a feed tube is held stationary relative to the sootblower frame. One end of the feed tube is supplied with the cleaning medium through a poppet valve. The lance tube slidably over-fits the feed tube and its longitudinal sliding and rotational motion is controlled by a carriage which moves along tracks on the sootblower frame. The cleaning medium supplied to the feed tube in turn pressurizes the hollow inside of the lance tube. The cleaning medium escapes from the lance tube through one or more nozzles which direct the spray against the surfaces to be cleaned. At the conclusion of a cleaning cycle, the lance tube is retracted and withdrawn from the combustion device to avoid exposure to intense heat which would destroy the lance tube.

Cleaning of slag and ash encrustations within the internal surfaces of a combustion device occurs through a combination of mechanical and thermal shock caused by the impact of the cleaning medium. In order to maximize this effect, designers of sootblowing equipment strive to design lance tubes and nozzles which produce a coherent stream of cleaning medium having a high peak impact pressure (i.e. maximum dynamic pressure at point of contact) and which can clean surfaces a long distance from the nozzle.

Various cleaning mediums are used in sootblowers. Steam and air are used in many applications. In order to maximize the cleaning effect, a stream which is fully expanded as it exits the nozzle is desired. Full expansion refers to a condition in which the static pressure of the stream exiting the nozzle approaches that of the ambient pressure surrounding the lance tube. Classical nozzle design theory for compressible fluids such as air or steam require that the nozzle have a throat with an expanding cross-sectional area which allows the pressure of the fluid to be reduced as it passes through the nozzle. The rate of expansion of the nozzle throat cross-sectional area is however limited by a desire to minimize boundary layer separation of the stream flowing through the nozzle, which limits the divergence angle of the nozzle throat surfaces. The occurrence of boundary layer separation leads to a turbulent flow regime which adversely affects the stream cleaning capabilities. Unfortunately, such conventional full expansion nozzles cannot readily be incorporated into many sootblower lance tubes since they tend to be longer than can be incorporated in the lance tube. Such constraints result since it is necessary to move the lance tube into and out of the combustion device through a small access port which limits the extent to which a nozzle can extend beyond the outside diameter of the lance tube. The length of the nozzle is also limited by a desire to ensure that the inlet end of the nozzle within the lance tube does not extend so far across the inside diameter of the lance tube that flow area through the lance tube is restricted. Accordingly, conventional full expansion nozzles cannot generally be incorporated into most retracting sootblowers.

By providing a sootblower nozzle having higher peak impact pressure and penetration ability, enhanced cleaning performance results which may permit a lower consumption of cleaning medium which can translate into a higher overall efficiency of the associated boiler. Moreover, by providing a more penetrating stream, it may be possible to decrease the number of sootblowers in a given area of a boiler required to provide a desired cleaning effect thereby providing considerable savings to the boiler operator in terms of capital investment and operating costs.

In accordance with the present invention, improvements over existing sootblower nozzles are provided. The nozzles according to this invention emulate the characteristics of a conventional full expansion nozzle while having a short length or "low profile" which can be incorporated into a sootblower lance. The nozzles of this invention have a nozzle throat with a centrally located plug which produces an annular flow passageway. By providing a diverging surface on the inside of the hollow nozzle shell, and a converging surface on the plug, the rate of expansion of cross-sectional area can be increased without violating divergence angle limitations. Such low profile nozzles have been evaluated in connection with this invention and found to provide performance which approaches that of conventional full expansion nozzles which have a completely open throat area.

This invention further encompasses various approaches toward mounting the plug within the nozzle throat. In one embodiment, the plug is supported by the back wall of the lance tube, whereas in another embodiment, the plug is supported by a radially extending supporting vane. In an additional embodiment, a one piece double-ended plug is used for diametrically opposed nozzles. While nozzles with annular flow passages are know generally, for example, modern jet engines can be thought of as such a nozzle, they have not been adapted to the environment of a sootblower lance tube where they provide unique benefits.

Further objects, features and advantages of the invention will become apparent from a consideration of the following description and the appended claims when taken in connection with the accompanying drawings.

DETAILED DESCRIPTION OF THE INVENTION

Figure 1:
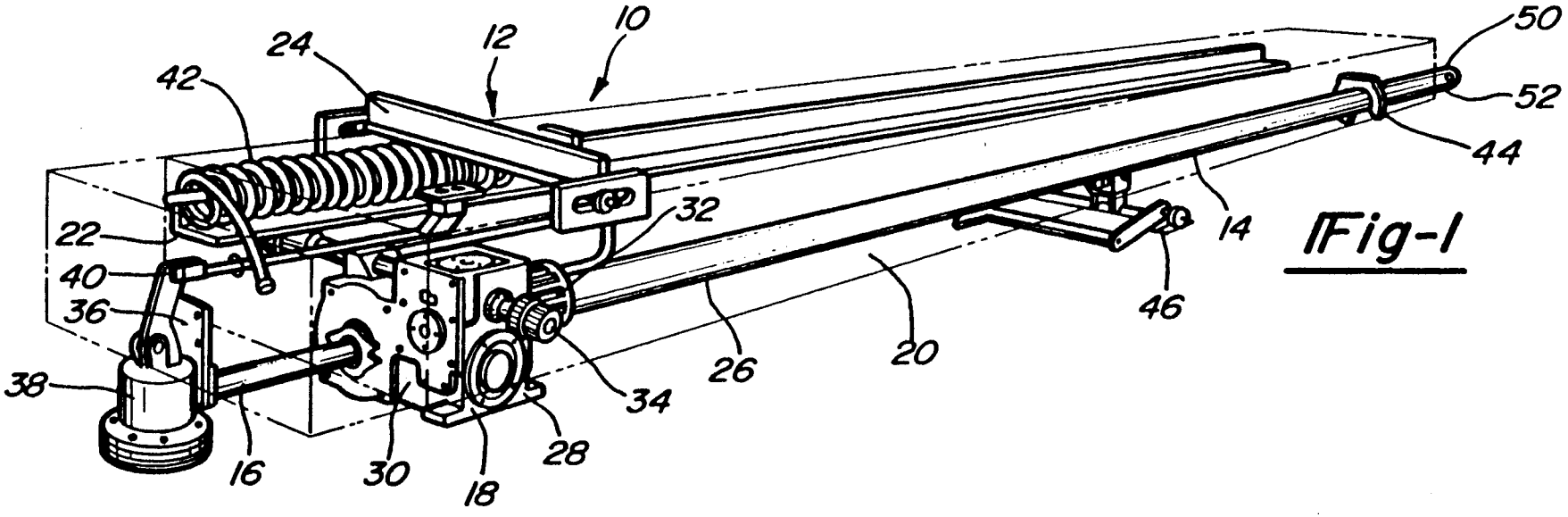
FIG. 1 is a pictorial view of a long retracting sootblower which is one type of sootblower which may incorporate a nozzle assembly of the present invention.

A representative sootblower which may incorporate the features of the present invention is shown in FIG. 1 and is generally designated there by reference number 10. Sootblower 10 principally comprises frame assembly 12, lance tube 14, feed tube 16, and carriage 18. Sootblower 10 is shown in its normal retracted resting position. Upon actuation, lance tube 14 is extended into and retracted from a combustion system such as a boiler (not shown) and may be simultaneously rotated.

Frame assembly 12 includes a generally rectangularly shaped frame box 20 which forms a housing for the entire unit. Carriage 18 is guided along two pairs of tracks located on opposite sides of frame box 20, including a pair of lower tracks (not shown) and upper tracks 22. A pair of toothed racks (not shown) are rigidly connected to upper tracks 22 and are provided to enable longitudinal movement of carriage 18. Frame assembly 12 is supported at a wall box (not shown) which is affixed to the boiler wall or another mounting structure and is further supported by rear support brackets 24.

Carriage 18 drives lance tube 14 into and out of the boiler and includes drive motor 26 and gear box 28 which is enclosed by housing 30. Carriage 18 drives a pair of pinion gears 32 which engage the toothed racks to advance the carriage and lance tube 14. Support rollers 34 engage the guide tracks to support carriage 18.

Feed tube 16 is attached at one end to rear bracket 36 and conducts the flow of cleaning medium which is controlled through the action of poppet valve 38. Poppet valve 38 is actuated through linkages 40 which are engaged by carriage 18 to begin cleaning medium discharge upon extension of lance tube 14, and cuts off the flow once the lance tube and carriage return to their idle retracted position, as shown in FIG. 1. Lance tube 14 over-fits feed tube 16 and a fluid seal between them is provided by a packing. A sootblowing medium such as air or steam flows inside of lance tube 14 and exits through one or more nozzles 50 mounted to nozzle block 52 which defines the distal end of the lance tube.

Coiled electrical cable 42 conducts power to the drive motor 26. Front support bracket 44 supports lance tube 14 during its longitudinal and rotational motion. For long lance tube lengths, an intermediate support 46 may be provided to prevent excessive bending deflection of the lance tube. Additional details of the construction of the well-known design of "IK" types of sootblowers manufactured by assignee can be found with reference to U.S. Pat. Nos. 3,439,367 and 4,803,959, which are hereby incorporated by reference.

Figure 2:
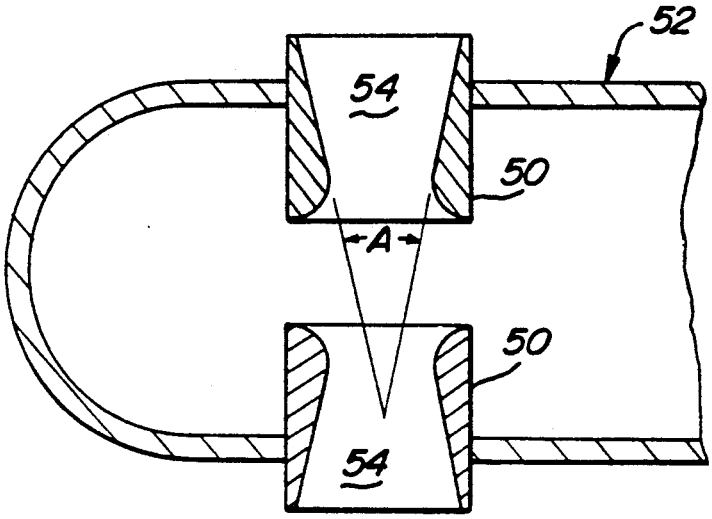
Fig-2 PRIOR ART
FIG. 2 is a cross-sectional view of a nozzle block in accordance with a conventional prior art configuration.

Now with reference to FIG. 2, a more detailed illustration of nozzle 50 and nozzle block 52 of prior art design is provided. As shown, nozzle block 52 includes a pair of diametrically opposite positioned nozzles 50. Nozzles 50 define an open throat area 54 which initially converges and then diverges much like a venturi tube which expands the cleaning fluid while minimizing boundary layer separation of the flow as it passes through the nozzle. As a guideline based on experimentation with sootblowers, nozzles 44 are generally provided with a divergence angle which is the included angle defined by the diverging inside surface of nozzle 50 designated by reference letter A of around 15 or less. If divergence angle A is increased significantly beyond that level, the risk of boundary layer separation and the attendant generation of turbulence results. As mentioned previously, the length of nozzle 44 is limited by a desire to maintain a minimal degree of extension of the nozzle from the outside diameter of nozzle block 46, and further the desire to not block the inlet of the nozzle. Also as shown, the diametrically opposite positioning of nozzles 44 further reduce the allowable length of each nozzle. Although it is possible to stagger the nozzles along the length of the lance tube, length limitations remain.

Nozzles for compressible fluids are often evaluated in terms of the degree of expansion of the fluid jet flowing through the nozzle which they provide. One expansion relationship is defined in terms of the static pressure of the steam as it emerges from the nozzle, as compared with the static pressure of the fluid field surrounding the nozzle exit (i.e. ambient pressure or the pressure in the combustion device). This relationship is frequently expressed as $P_e/P_\infty$ where $P_e$ is the static pressure of the exiting stream and $P_\infty$ is the ambient pressure. Due to the length limitations and the normal pressures at which air or steam is delivered to sootblowers, conventional sootblower nozzles such as shown in FIG. 2 in widespread use in sootblower applications have a $P_e/P_\infty$ ratio which is often around 4. In other words, the stream emerging from nozzle 44 is highly underexpanded. Thus the fluid stream undergoes significant expansion after exiting the nozzle. Since the cleaning medium flow is generally supersonic through the throat of sootblower nozzles and the stream is high underexpanded, a normal shock area close to the nozzle results also referred to as a "Mach disk" phenomenon. This results in a significant decrease in the jet energy in the fluid exiting the nozzle.

A recognized principle of supersonic fluid flow through nozzles is that Mach disk formation is avoided when $P_\infty/P_\infty$ is equal to 2 or less. In order to produce a pressure ratio in that range it would appear that all that is necessary is to provide a greater divergence angle (angle A) to more fully expand the flow as it exits the nozzle. However, as mentioned previously, increases in divergence angle necessary to produce such area change tends to result in boundary layer separation which degrades the peak impact pressure or jet energy of the stream being emitted.

Figure 3:
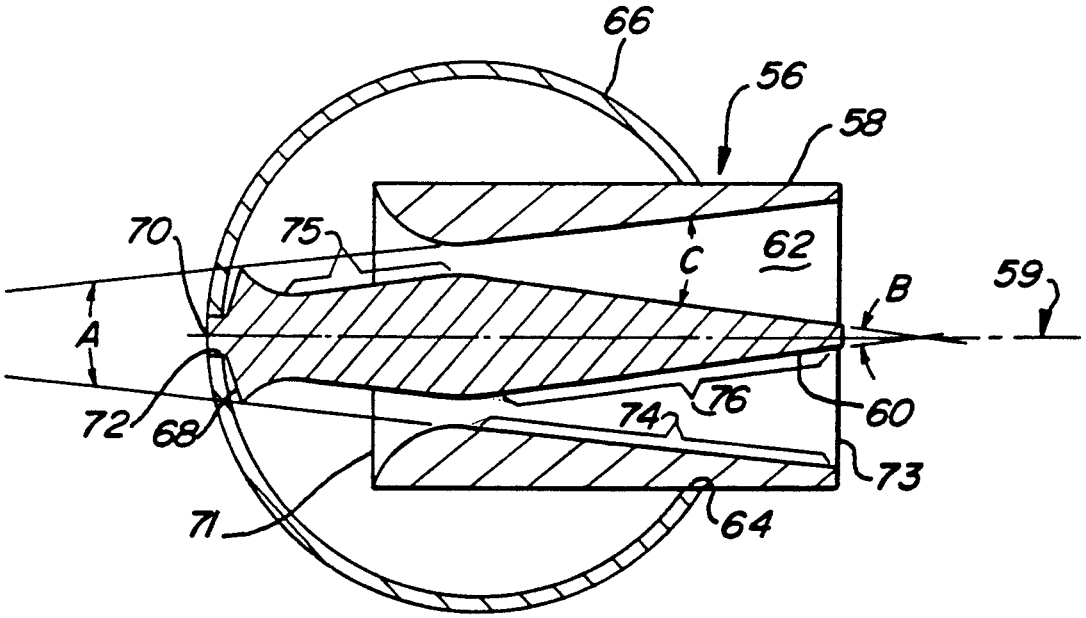
FIG. 3 is a cross-sectional view through a nozzle block showing a low profile nozzle in accordance with a first embodiment of this invention.
Figure 4:
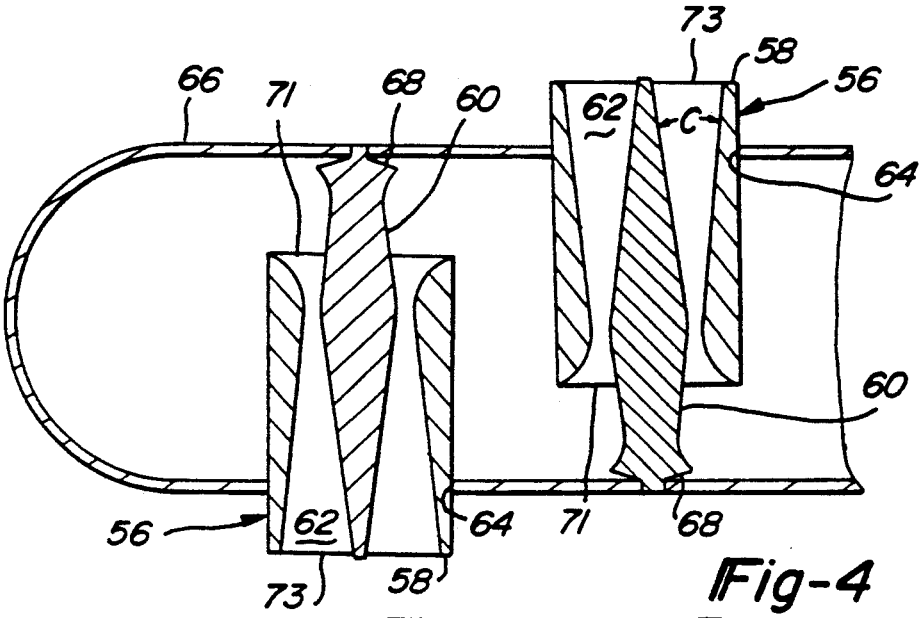
FIG. 4 is a cross-sectional view through the nozzle block shown in FIG. 3 showing a pair of low profile nozzles in a staggered relationship.
Figure 5:
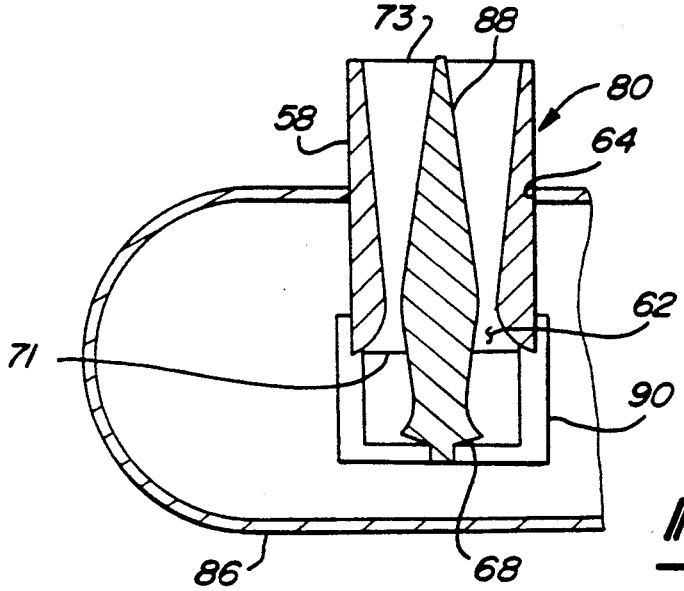
FIG. 5 is a cross-sectional view through a nozzle block having a low profile nozzle assembly in accordance with a second embodiment of this invention.

Now with reference to FIGS. 3 and 4, a low profile nozzle assembly in accordance with a first embodiment of this invention is shown and is generally designated by reference number 56. Nozzle assembly 56 includes a hollow outer shell 58 having an inlet 71 and outlet 73 and a converging/diverging inside surface configuration, similar to that of conventional nozzle 44. Outer shell 58 is rotationally symmetrical about nozzle longitudinal axis 59. Nozzle assembly 56 further includes plug 60 disposed coaxially within outer shell 58 to produce an annular nozzle throat 62. As shown, outer shell 58 is shown inserted within port 64 which is cut into nozzle block 66, and is welded in place. As shown, nozzle outer shell 58 extends somewhat beyond the outside diameter of nozzle block 66, which is permitted in certain applications. Plug 60 has a diverging section 75 (when viewed in the direction of the fluid flow) at its base and a converging section 76, and defines a mounting base 68 having a protruding mounting post 70. Plug 60 is rotationally symmetrical about axis 59 and is mounted in place by positioning post 70 within nozzle block bore 72 where it is welded in position.

As it is true in the design of conventional sootblower nozzles for steam or air, it is important to limit the divergence angle of the stream as it flows through nozzle assembly 56. As shown in FIG. 3, the inside surface of outer shell 58 defines a diverging surface 74 having an included angle designated by reference letter A. Plug converging surface 76 defines a convergence angle as shown in FIG. 3 designated by reference letter B. The combined included divergence angle within throat 62 is designated by reference letter C, which is simply $\frac{1}{2}A+\frac{1}{2}B$, and in keeping with guidelines intended to minimize the occurrence of boundary layer separation is limited to about 15°. Thus if both angles A and B are maintained to be identical, they are both limited by the 15 guideline. Through analysis and experimentation, low profile nozzle assembly 56 has been found to produce increases in the jet energy of the sootblowing medium exiting the nozzle as compared with ¢open throat" nozzles of conventional configuration. These benefits are achieved since the annular throat 62 defined by nozzle assembly 56 has a more rapid increase in the rate by which its cross-sectional area increases, without exceeding the critical divergence angle mentioned previously. This increased rate of expansion allows more complete stream expansion to occur within a limited nozzle length. Nozzle assembly 56 is designed to provide a pressure ratio $P_e/P_\infty$ of equal to or less than 2. By maintaining the pressure ratio in this region, the point of transition of the flow from supersonic to subsonic velocity occurs a greater distance from the exit of the nozzle assembly 56 which results in a higher peak impact pressure along the jet. In addition, the subsonic transition tends to produce oblique shock waves, which generally degrade jet energy less than the normal shock wave of the "Mach disk".

As shown in FIG. 3, plug diverging surface 75 extends well beyond inlet 71 of nozzle shell 58 (shown extended about one-quarter of its total length). This feature is believed to improve the inlet conditions of the cleaning medium as it enters the nozzle, since it aids in directing the fluid into nozzle inlet 71. This feature is especially important since the cleaning medium flowing inside lance 14 must undergo a sharp turn of about 90° as it enters and flows out of nozzle assembly 56.

As is evident from the configuration of nozzle assembly 56 shown in FIG. 3, this configuration of a nozzle assembly does not permit diametrically opposite positioning of two or more nozzles. As is shown in FIG. 4, a longitudinally staggered orientation, however, can be provided. In that FIGURE, a pair of identical nozzle assemblies 56 are shown installed within nozzle block 66. The use of a pair of opposed jets as shown in FIG. 4 is often provided as a means of balancing reaction forces acting on the lance tube during the sootblower cleaning.

Figure 6:
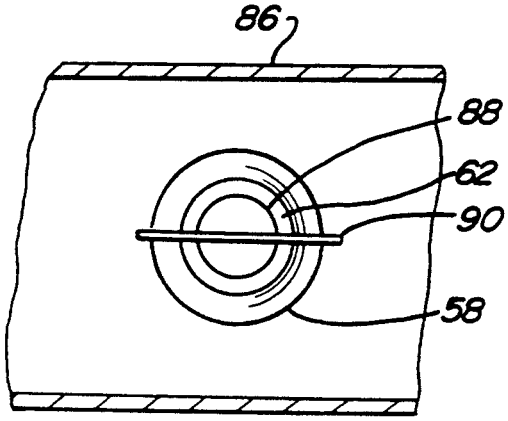
FIG. 6 is a bottom view of the nozzle assembly shown in FIG. 5.

Now with reference to FIG. 6, a low profile nozzle assembly in accordance with a second embodiment of this invention is shown as is generally designated by reference number 80. Nozzle assembly 80 includes an outer shell which is identical to shell 58 and is therefore designated by reference numbers used previously. As in the prior embodiment, plug 88 is disposed coaxially along longitudinal axis 59. This embodiment of a nozzle assembly 80, however, differs from that described previously with respect to the manner of supporting plug 88. As opposed to mounting the plug to the diametrically opposing inside surface of the lance tube, a support vane 90 is provided attached to both outer shell 58 and plug 88. Preferably vane 90 is formed from sheet metal stock so as to minimize the flow restrictions of the cleaning medium entering throat 62. As in the prior embodiment, vane 90 enables plug 88 to protrude from the nozzle inlet 71 to aid in providing good inlet flow conditions. In all other respects, nozzle assembly 80 is dimensionally consistent and operates in the manner of nozzle assembly 56.

Figure 7:
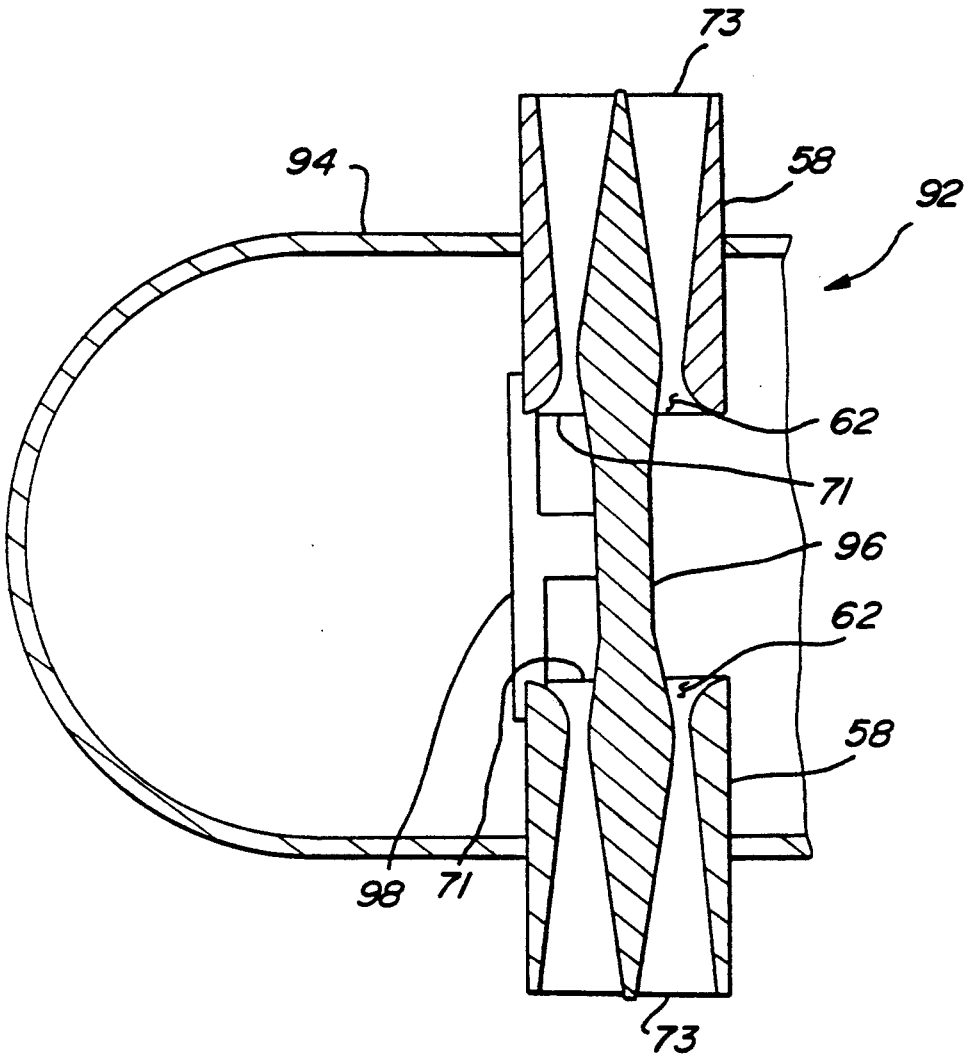
FIG. 7 is a cross-sectional view of a nozzle assembly in accordance with a third embodiment of this invention.

FIG. 7 shows a third embodiment of a nozzle assembly of this invention designated by reference number 94 which enables diametrically opposite positioning of a pair of low profile nozzles in accordance with this invention. Nozzle assembly 94 includes a pair of outer shells 58, with a one-piece double-ended plug 96 extending into both shells. Vane 98 is welded to plug 96 and both shells 58 to support the plug. The dimensional relationships described previously are provided in both nozzles shown in FIG. 7 and they accordingly operate in a similar fashion.

While the nozzle assemblies of this invention were described with a long retracting sootblower, they can be applied in various types of sootblowing equipment. While the above description constitutes the preferred embodiments of the present invention, it will be appreciated that the invention is susceptible of modification, variation and change without departing from the proper scope and fair meaning of the accompanying claims.

We claim:

1. A nozzle assembly for discharging a jet of a fluid cleaning medium from a sootblower lance tube defining a hollow inside passage for cleaning surfaces within a combustion device comprising:

a hollow cylindrical shell affixed to said lance tube defining an inlet and an outlet for the fluid cleaning medium and said shell having a diverging inside surface with respect to the direction of flow of the fluid cleaning medium through said shell, and a plug positioned coaxially within said shell and having a converging outer surface with respect to the direction of flow of the fluid cleaning medium through said shell, wherein said shell and said plug defining a throat for conducting the fluid cleaning medium from within the lance tube inside passage against the combustion device surfaces, said throat having an annular configuration and a cross-sectional area which increases in the direction of flow of the fluid cleaning medium through said throat.

2. A nozzle assembly according to claim 1 wherein the included angle formed by said shell diverging inside surface is equal to or less than 15 degrees.

3. A nozzle assembly according to claim 1 wherein the included angle formed by said plug converging outer surface is equal to or less than 15 degrees.

4. A nozzle assembly according to claim 1 wherein the included angle formed between said shell diverging inside surface with respect to said plug converging outer surface is equal to or less than 15°.

5. A nozzle assembly according to claim 1 wherein said plug is affixed directly to said lance tube.

6. A nozzle assembly according to claim 5 wherein said plug is affixed to said lance tube at a position on the inside passage of the lance tube aligned with the longitudinal axis of said shell.

7. A nozzle assembly according to claim 1 wherein said plug is affixed to said shell by a vane extending therebetween.

8. A nozzle assembly according to claim 1 wherein said nozzle assembly throat causes an expansion of the cleaning medium such that the static pressure of the cleaning medium discharged from said shell exit is less than twice the ambient pressure of a fluid surrounding the lance tube.

9. A nozzle assembly according to claim 1 wherein the cleaning medium reaches a supersonic velocity within said nozzle assembly throat.

10. A nozzle assembly according to claim 1 wherein said plug protrudes from said shell inlet.

11. A nozzle assembly according to claim 1 wherein said nozzle assembly is disposed within the lance tube such that the flow of the cleaning medium undergoes a change of direction of about 90° upon entering said shell inlet.

12. A nozzle assembly according to claim 1 wherein a pair of said nozzle assemblies are positioned in a diametrically opposite relationship within the lance tube inside passage with a pair of said plugs extending into said outer shells of said pair of nozzle assemblies.

13. A nozzle assembly for discharging a jet of a fluid cleaning medium from a sootblower lance tube defining a hollow inside passage for cleaning surfaces within a combustion device comprising:

a hollow cylindrical shell affixed to said lance tube defining an inlet and an outlet for the fluid cleaning medium and said shell having a diverging inside surface with respect to the direction of flow of the fluid cleaning medium through said shell and wherein the included angle formed by said diverging surface is equal to or less than 15 degrees, and a plug positioned coaxially within said shell and having a converging outer surface with respect to the direction of flow of the fluid cleaning medium through said shell, wherein the included angle formed by said plug converging outer surface is equal to or less than 15 degrees and wherein said shell and said plug define a throat for conducting the fluid cleaning medium from within the lance tube inside passage against the combustion device surfaces, said throat having an annular configuration and a cross-sectional area which increases in the direction of flow of the fluid cleaning medium through said throat, said cross-sectional area which increases in the direction of flow of the fluid cleaning medium through said throat, said cross-sectional area increasing such that the static pressure of the cleaning medium discharged from said nozzle exit is less than twice the ambient pressure of fluid surrounding the lance tube.

14. A nozzle assembly according to claim 13 wherein said plug is affixed directly to said lance tube.

15. A nozzle assembly according to claim 14 wherein said plug is affixed to said lance tube at a position on the inside passage of the lance tube aligned with the longitudinal axis of said shell.

16. A nozzle assembly according to claim 13 wherein said plug is affixed to said shell by a vane extending therebetween.

17. A nozzle assembly according to claim 13 wherein the cleaning medium reaches a supersonic velocity within said nozzle assembly throat.

18. A nozzle assembly according to claim 13 wherein said plug protrudes from said shell inlet.

19. A nozzle assembly according to claim 13 wherein said nozzle assembly is disposed within the lance tube such that the flow of the cleaning medium undergoes a change of direction of about 90° upon entering said shell inlet.

20. A nozzle assembly according to claim 13 wherein the included angle formed between said shell diverging inside surface with respect to said plug converging outer surface is equal to or less than 15°.

21. A nozzle assembly according to claim 13 wherein a pair of said nozzle assemblies are positioned in a diametrically opposite relationship within the lance tube inside passage with a pair of said plugs extending into said outer shells of said pair of nozzle assemblies.

22. A nozzle assembly for discharging a jet of a fluid cleaning medium from a sootblower lance tube defining a hollow inside passage for cleaning surfaces within a combustion device comprising:

a hollow cylindrical shell affixed to said lance tube defining an inlet and an outlet for the fluid cleaning medium and said shell having a diverging inside surface with respect to the direction of flow of the fluid cleaning medium through said shell, and a plug positioned coaxially within said shell and having a converging outer surface with respect to the direction of flow of the fluid cleaning medium through said shell, wherein said shell and said plug define a throat for conducting the fluid cleaning medium from within the lance tube inside passage against the combustion device surfaces, said throat having an annular configuration and a cross-sectional area which increases in the direction of flow of the fluid cleaning medium through said throat, said plug being affixed directly to said lance tube at a position on the inside passage of the lance tube aligned with the longitudinal axis of said nozzle.

23. A nozzle assembly according to claim 22 wherein the included angle formed by said shell diverging inside surface is equal to less than 15 degrees.

24. A nozzle assembly according to claim 22 wherein the included angle formed by said plug converging outer surface is equal to or less than 15 degrees.

25. A nozzle assembly according to claim 22 wherein the included angle formed between said shell diverging inside surface with respect to said plug outer surface is equal to or less than 15°.

26. A nozzle assembly according to claim 22 wherein said nozzle assembly throat causes an expansion of the cleaning medium such that the static pressure of the cleaning medium discharged from said shell exit is less than twice the ambient pressure of fluid surrounding said lance tube.

27. A nozzle assembly according to claim 22 wherein the cleaning medium reaches a supersonic velocity within said nozzle assembly throat.

28. A nozzle assembly according to claim 22 wherein said plug protrudes from said shell inlet.

29. A nozzle assembly according to claim 22 wherein said nozzle assembly is disposed within the lance tube such that the flow of the cleaning medium undergoes a change of direction of about 90° upon entering said shell inlet.

30. A nozzle assembly according to claim 22 wherein a pair of said nozzle assemblies are positioned in a diametrically opposite relationship within the lance tube inside passage with a pair of said plugs extending into said outer shells of said pair of nozzle assemblies.

31. A nozzle assembly for discharging a jet of fluid cleaning medium from a sootblower lance tube defining a hollow inside passage for cleaning surfaces within a combustion device comprising:

a hollow cylindrical shell affixed to said lance tube defining an inlet and an outlet for the fluid cleaning medium, and a plug positioned coaxially within said shell and having a converging outer surface with respect to the direction of flow of the fluid cleaning medium through said shell wherein said shell and said plug defining a throat for conducting the fluid cleaning medium from within the lance tube inside passage against the combustion device surfaces, said throat having an annular configuration and a cross-sectional area which increases in the direction of flow of the fluid cleaning medium through said throat.

32. A nozzle assembly according to claim 31 wherein the included angle formed by said plug converging outer surface is equal to or less than 15 degrees.

33. A nozzle assembly according to claim 31 wherein said plug is affixed directly to said lance tube.

34. A nozzle assembly according to claim 31 wherein said plug is affixed to said shell by a vane extending therebetween.

35. A nozzle assembly according to claim 31 wherein said nozzle assembly throat causes an expansion of the cleaning medium such that the static pressure of the cleaning medium discharged from said shell exit is less than twice the ambient pressure of a fluid surrounding the lance tube.

36. A nozzle assembly according to claim 31 wherein the cleaning medium reaches a supersonic velocity within said nozzle assembly throat.

37. A nozzle assembly according to claim 31 wherein said plug defines a segment protruding from said shell inlet for aiding in guiding said fluid cleaning medium through said nozzle assembly.

* * * * *

UNITED STATES PATENT AND TRADEMARK OFFICE

CERTIFICATE OF CORRECTION

PATENT NO. : 5,271,356
DATED : December 21, 1993
INVENTOR(S) : Sean Kling, et al.

It is certified that error appears in the above-indentified patent and that said Letters Patent is hereby corrected as shown below:

Column 9, Line 11, Claim 31 after "of" insert --a--.

Signed and Sealed this

Twenty-first Day of June, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,271,356
DATED : December 21, 1993
INVENTOR(S) : Sean Kling, et al.

It is certified that error appears in the above-indentified patent and that said Letters Patent is hereby corrected as shown below:

Column 5, Line 25, delete "$\frac{1}{4}$A + $\frac{1}{4}$B" and insert —$\frac{1}{2}$A + $\frac{1}{2}$B—.

Signed and Sealed this

Twentieth Day of June, 1995

*Attest:*

Bruce Lehman

BRUCE LEHMAN

*Attesting Officer*

*Commissioner of Patents and Trademarks*